US006168056B1

(12) United States Patent
Bertholon

(10) Patent No.: US 6,168,056 B1
(45) Date of Patent: Jan. 2, 2001

(54) DEVICE FOR INFLATING/DEFLATING THE SHOULDER STRAPS OF A MEANS INTENDED TO BE WORN ON THE BACK BY A PERSON

(75) Inventor: Christiane Bertholon, Saint Marcellin (FR)

(73) Assignee: Tenesee S.A., Montrond-les-Bains (FR)

( * ) Notice: Under 35 U.S.C. 154(b), the term of this patent shall be extended for 0 days.

(21) Appl. No.: 08/973,130

(22) PCT Filed: May 21, 1996

(86) PCT No.: PCT/FR96/00754

§ 371 Date: Apr. 20, 1998

§ 102(e) Date: Apr. 20, 1998

(87) PCT Pub. No.: WO96/38065

PCT Pub. Date: Dec. 5, 1996

(30) Foreign Application Priority Data

May 31, 1995 (FR) ..... 95 06731

(51) Int. Cl.[7] ..... A45F 3/12

(52) U.S. Cl. ..... 224/264; 224/643; 24/163 R; 417/234; 417/480

(58) Field of Search ..... 224/643, 642, 224/644, 627, 264; 24/163 R, 200; 417/234, 472, 480; 36/29, 88

(56) References Cited

U.S. PATENT DOCUMENTS 3,883,053 * 5/1975 Pritchard et al. .
5,840,400 * 11/1998 Landi et al. ..... 428/116

FOREIGN PATENT DOCUMENTS

271951 * 3/1914 (DE) .
948 829 * 8/1949 (FR) .
2 697 143 * 4/1994 (FR) .
2 700 675 * 7/1994 (FR) .
219874 * 8/1924 (GB) .
94/28756 * 12 1994 (WO) .

* cited by examiner

*Primary Examiner*—Linda J. Sholl
(74) *Attorney, Agent, or Firm*—Wall Marjama & Bilinski

(57) ABSTRACT

A device for inflating and deflating the shoulder strap of a satchel that includes an inflatable cushion located inside the strap that is connected to an inflation/deflation mechanism formed of a resilient deformable material including a bulb-like pump and a deformable valve housing coupled to the pump by a connecting line. The valve housing contains a ball valve that automatically opens when the pump is activated to inflate the cushion and closes to prevent air from escaping from the cushion when the pump is deactivated. Depressing the valve housing displaces the ball valve allowing air to escape from the cushion. The inflation/deflation mechanism is integrally mounted inside a pad that is attachable to a satchel by a fixed strap and an adjustable strap.

6 Claims, 4 Drawing Sheets

DEVICE FOR INFLATING/DEFLATING THE SHOULDER STRAPS OF A MEANS INTENDED TO BE WORN ON THE BACK BY A PERSON

BACKGROUND OF THE INVENTION

The invention relates to the technical field of satchels and rucksacks (backpacks) that may be intended for school, sporting or hiking use.

School satchels are often designed to be worn on the back by the pupil and the shoulder straps press on the shoulders. This type of satchel has the advantage of freeing the pupil's hands and, above all, ensures a better balanced load. The load can be relatively heavy, of the order of 10 to 20 kg, depending on the number of files and books carried. There is therefore a need to improve, as much as possible, carrying comfort.

Hiking rucksacks that can be used for any purpose and for leisure use in particular may, in some cases, be heavily loaded with products and various clothing, thus making it necessary to improve carrying comfort.

In view of the problems mentioned above, there have been proposals to make the shoulder straps of satchels, backpacks or similar bags with built-in inflatable means, thus making it possible to create pockets of air to improve and make the carrying of such articles more comfortable. Many patents have been filed in this area, e.g. FR 1028577, AT 675838, FR 2406402, FR 2697143.

In these embodiments, the inflatable element was introduced directly into the shoulder strap with an external means of control used to ensure inflation or deflation.

Proposals have also been made, in numerous patents, to incorporate in the rear surface or the bottom of the satchel one or more inflatable chambers with pumps or external bulb inflators with this assembly offering improved carrying comfort.

Various investigations that have been carried out demonstrate that the need to lighten and/or make the carrying of packs or satchels more comfortable are very real and meet genuine medical concerns to protect the pupil or wearer, especially their vertebral column.

Although the concept of inflating certain parts or components of the pack and/or satchel offer undeniable benefits, in practice certain drawbacks or inadequacies in the protection of the means of inflation or deflation have been observed. If the latter is an inflator bulb as described in Patent FR 2700675 or a bellows, it generally remains visible from outside the pack or satchel. It can be operated by persons other than the wearer with all the resulting risks of damage, puncture and other risks of the same type.

In addition, once the pack or satchel is worn by the user, none of the known techniques makes it possible to vary, if required, the degree of inflation in order to adapt it to the carried load and therefore to adjust inflation as required.

SUMMARY OF THE INVENTION

The object sought after by the invention was to devise an inflation/deflation device for shoulder straps associated with a pack, satchel or similar that would, on the one hand, be protected as such, be operable chiefly by the user and adjustable during use as required.

These objects and others will become apparent from the following description.

According to a first aspect, the device for inflating/deflating the shoulder straps of a means of the satchel, pack or similar type intended to be worn on the back by a person, the shoulder strap or straps comprising an inflatable integral cushion controlled by an external means of inflating the shoulder strap, is distinctive in that the inflation/deflation device is incorporated in a one-piece part constituting the means of guiding and adjusting the length of the strap attached to the pack, satchel or similar, said one-piece part forming a pad being shaped and devised to ensure positioning of the means of inflating/deflating the shoulder straps, its protection, its connection to one of the ends of the shoulder strap whilst allowing the injection of inflating air into the cushion incorporated in the shoulder strap.

These aspects and others will become apparent from the following description.

BRIEF DESCRIPTION OF THE DRAWINGS

The object of the present invention is described, merely by way of example, in the accompanying drawings in which.

DESCRIPTION OF THE INVENTION

In order that the present invention may more readily be understood, the following description is given, merely by way of example, reference being made to the accompanying drawings.

The device for inflating/deflating the shoulder straps is referred to in its entirety as (1) and has applications for packs, satchels (2) and, generally speaking, any article that can be worn on the back by a user and which demands the use of shoulder straps that press onto the user's shoulders.

The shoulder straps are made in a known manner of fabric or any other material and are attached at one end **(3*a*) to the rear wall (2*a*) or shell of the satchel by any known appropriate means and to a quick-release fastener at the other end (3*b*) allowing connection to a strap (4) joined to the lower part (2*b*)** of the satchel.

Figure 1:
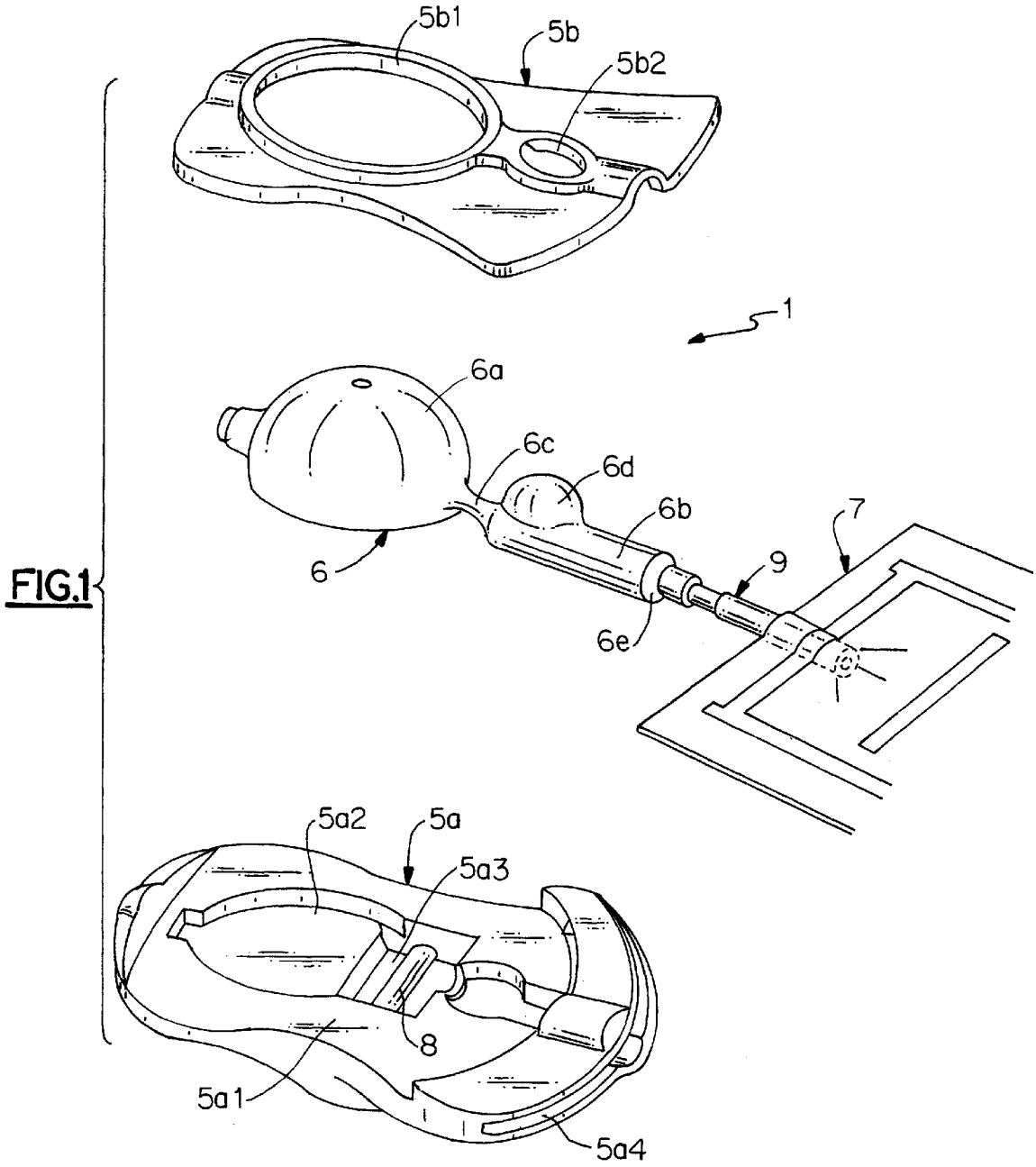
FIG. 1 is a perspective view before assembly of the inflation/deflation device according to the invention intended to be incorporated in the closing loop of a pack, satchel or similar shoulder strap.
Figure 2:
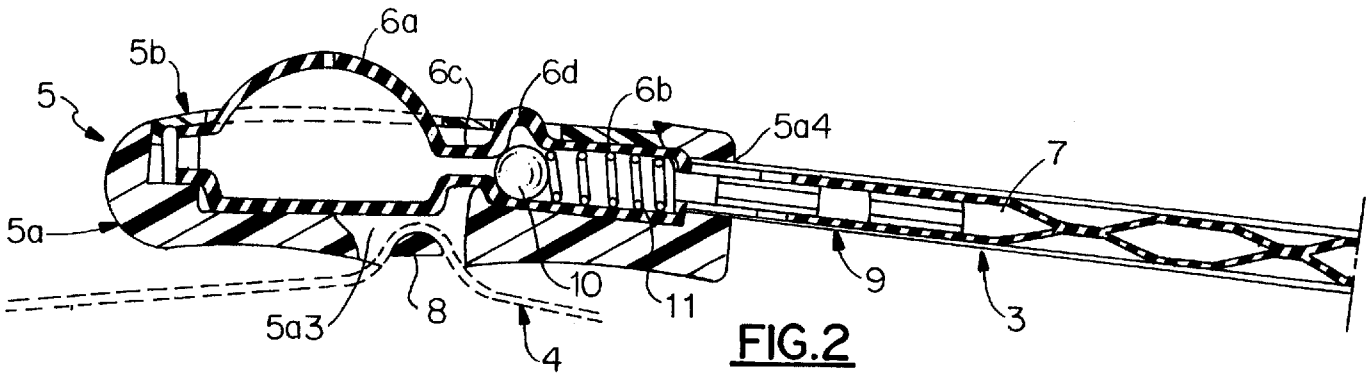
FIG. 2 is a longitudinal section of the device according to the invention after assembly and its integration into the closing loop.
Figure 3:
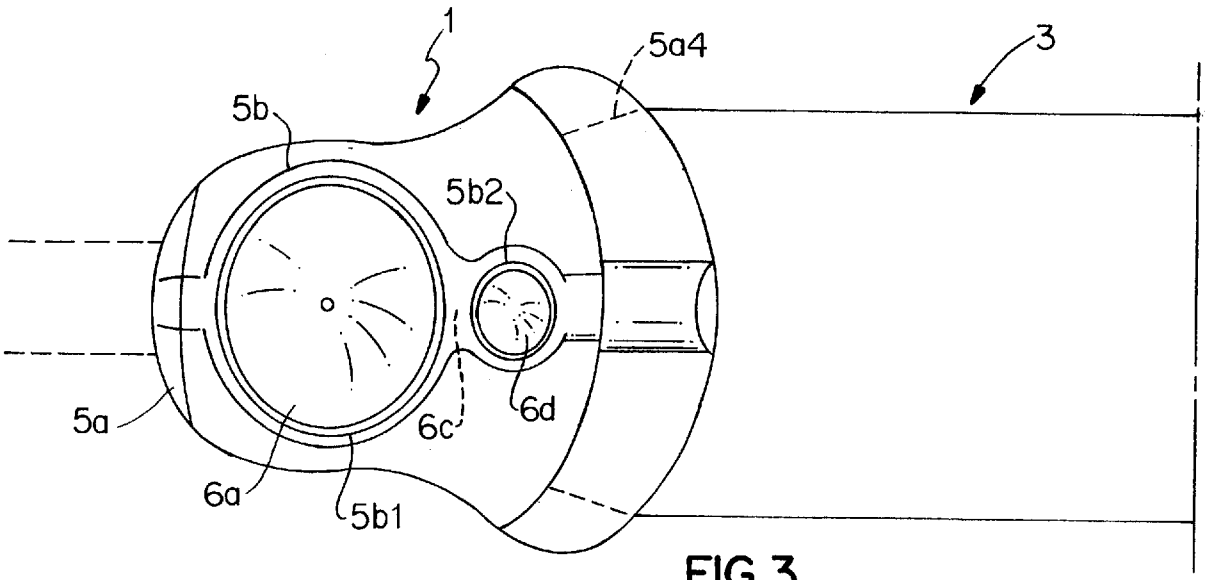
FIG. 3 is a plan view according to FIG. 2.
Figure 4:
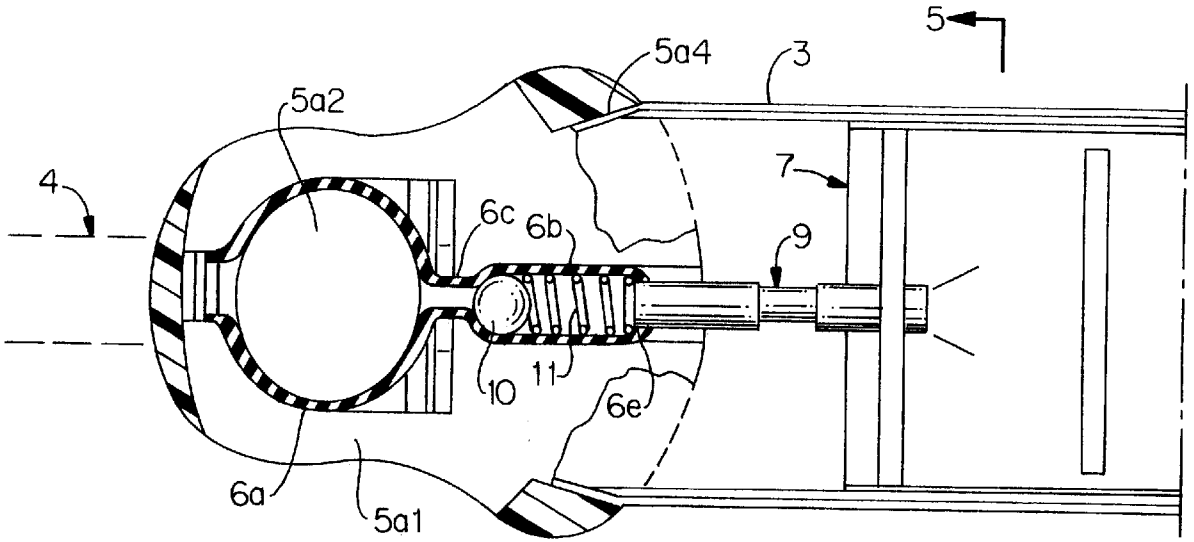
FIG. 4 is a view according to FIG. 3 but in section showing the means of operating the inflation/deflation device.
Figure 5:
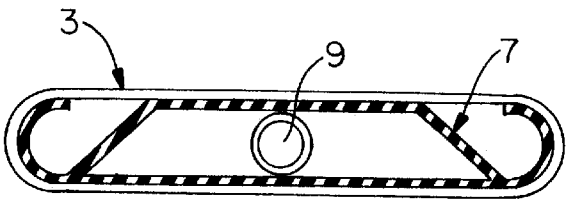
FIG. 5 is a transverse sectional view along line A—A in FIG. 4.
Figure 6:
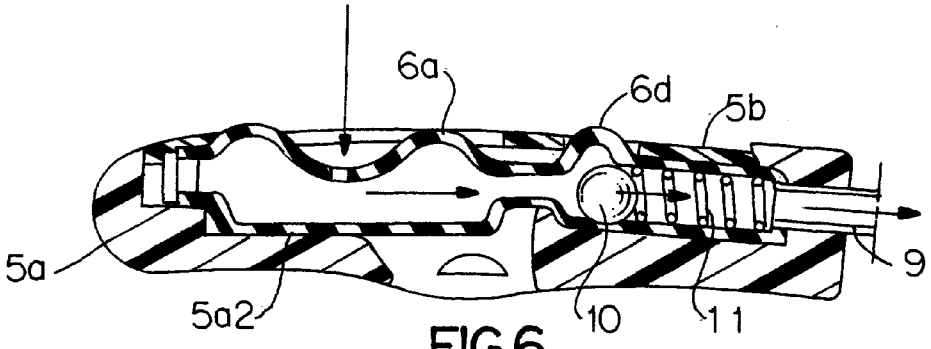
FIG. 6 is a longitudinal section of the device showing the shoulder strap inflation phase.

According to the invention, the inflation/deflation device (1) is incorporated in a one-piece part (5) herein referred to as a pad constituting the means of guiding and adjusting the length of the strap, said part itself being connected to the shoulder strap by making the means of inflation member (6) communicate with an inflatable cushion (7) incorporated in the shoulder strap. A device of this type is provided on each shoulder strap of the satchel. The inflation member is formed of a resilient material that can be deformed as illustrated in FIG. 6.

The one-piece part (5) forming a shaped pad is made of any appropriate material and is devised to fulfil four functions, namely:

protecting the inflation/deflation device, positioning it, connection to one of the ends (3*b*) of said shoulder strap (3), allowing the injection of inflating air, connection to the length-adjustment strap (4) in order to adjust the carrying position of the satchel for the user.

The pad of the one-piece part (5) is shaped in any appropriate manner with a flat cross section and may have a well styled, attractive appearance.

The pad of the one-piece part (5) is advantageously made in two parts with a base (5*a*) and a cover (5*b*), the latter being separately mounted and fixed by bonding or other means. The stretched-shape base has, in its central part (5*a*1), a cavity (5*a*2) making it possible to position the inflation means (6) which must be connected to cushion (7). The base has an opening (5*a*3) in its thickness located in the above-mentioned central part and accommodating a shaft (8) integrally made during the manufacture of the pad and making it possible to guide and deflect the adjustment strap (4) that is physically connected to the pack or satchel. Said base (5*a*) also comprises, at one of its ends, a tunnel shape (5*a*4) making it possible to guide and attach the end (3*b*) of the shoulder strap by any appropriate means. This tunnel shape (5*a*4) is shaped to permit and provide room for the connecting tube (9) between the inflation means (6) and cushion (7) incorporated in the shoulder strap. Said inflation member includes a bulb shape (6*a*) intended to be centred in the central part of the cavity of the pad, said bulb extending as a pipe (6*b*) capable of penetrating into said part forming a tunnel (5*a*4) on the one hand, and permitting, on the other hand, connection to the cushion by means of an appropriate connecting tube (9). The pipe part (6*b*) is capable of fitting into a recess that matches its shape made in the thickness of the pad, this recess being arranged advantageously in the median axial plane of the pad. Said pipe (6*b*) is therefore maintained securely in position.

Communication between the pipe (6*b*) and bulb (6*a*) is via a reduced-diameter channel (6*c*) that delimits on the bottom of the pipe a seat shape of which the function will be specified below. Vertically above the area where the pipe and reduced-diameter channel are connected, there is provision for an additional protruding bump (6*d*) capable of receiving, during certain phases, a ball (10) of small cross-sectional area. This ball is pushed into the pipe by a spiral spring (11) that is suitably guided into the latter, said ball blocking off the connecting channel (6*c*) between the bulb and the pipe when the inflation/deflation means is not in use. Spring (11) is secured in said pipe by a retention lip (6*e*) formed on the outside of the pipe.

Cover (5*b*) which is separately mounted on the pad is devised with two circular openings (5*b*1–5*b*2) of appropriate size to surround and protect, on the one hand, the bulb part 6*a* of the inflation means and, on the other hand, the bump part 6*d* of the air pipe, leaving the protruding projecting parts of the bulb and of the bump visible.

Cushion (7) which is linked to inflation means (6) is long and is inserted inside the actual shoulder strap. In a known manner, this cushion may comprise various chambers that communicate with each other making it possible to split up the inflation zone into segments. The connecting tube between the cushion and the inflation device is made in any appropriate manner.

The operation of the device will now be described. Each shoulder strap of the satchel or pack is devised with such a device. The end of the shoulder strap is attached, as stated previously, on the pad by any appropriate known means and the cushion is made to communicate with the inflation device via the intermediate tube. The lower strap attached to the pack or satchel has been inserted into the lower part of the pad into the opening so that the entire assembly is securely held.

When not in use, the shoulder straps are not inflated. When the user has correctly put the satchel or pack onto their back, the shoulder straps are located over the individual's chest. Using the right or left hand, the user simply needs to press the bulb as shown in FIG. 6 in order to ensure inflation. The pressure exerted on the bulb makes it possible to expel the air and push the ball in opposition to the spring in the connecting pipe, the air then being forced into the cushion located inside the shoulder strap. The user repeats this operation several times in order to obtain the desired inflation pressure. After inflation, the inflation bulb is no longer used and the ball, under the effect of the spring's decompression force, returns to its original position, thus blocking off the seating of the bottom of the pipe.

Figure 7:
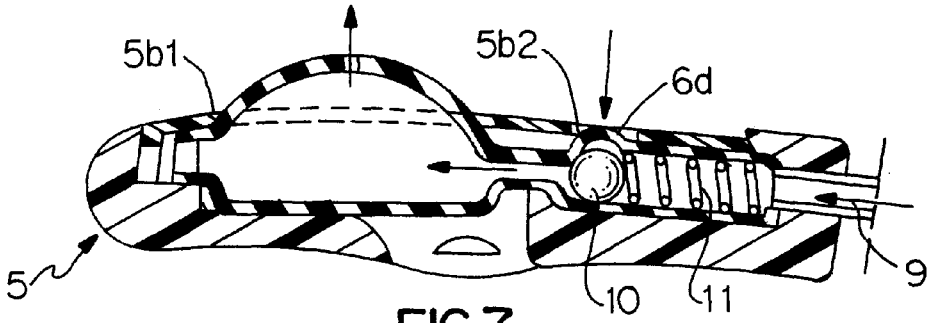
FIG. 7 is a view similar to FIG. 6 but during the shoulder strap deflation phase.
Figure 8:
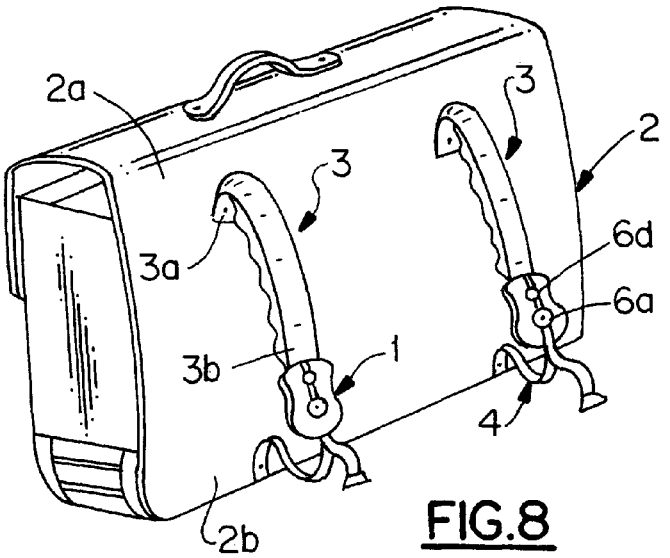
FIG. 8 is a view of the application of the device according to the invention to a satchel.

To ensure the deflation function shown in FIG. 7, the user simply has to press on the bump 6*d* of the pipe, this pressure causes displacement of the ball in the pipe and frees the reduced-diameter channel between the bulb and the pipe. The air can escape into the bulb and into the outside atmosphere through an opening in the bulb. The cushion is gradually deflated until all the air is evacuated.

The device according to the invention is very simple to produce and operate. According to the invention, the inflation/deflation device is entirely integrated into the support pad which also provides connection to the lower strap. The entire device is produced so that its various components cannot be tampered with because only the bulb and the deflation means can be accessed.

The pad may also be of any appropriate shape and profile. The area where the lower strap is connected and deflected may be arranged differently, for instance, at the end of the pad opposite the area where the shoulder strap is attached.

As well as its functional aspect, the inflation device therefore helps give the pad its special attractive appearance.

The user can, depending on the load, adjust, in each shoulder strap, the inflation pressure, thus obtaining optimum comfort at their discretion.

The integral cushion in the shoulder strap is of any appropriate shape and design.

What is claimed is:

1. Apparatus for carrying a satchel on a person's back that includes:

an adjustable strap that is adapted to be attached at one end to a satchel, an inflatable cushion mounted inside said shoulder strap and extending along the length of said strap, a pad attached to the other end of said strap, a manually activated pump contained within said pad that is integral with a valve and a connecting line for coupling the pump to said valve, a pipe for connecting the valve to said cushion, a ball mounted within the valve that is adapted to close against the connecting line, and a spring acting against said ball to bias the ball into closure against said connecting line and wherein said ball automatically opens when the pump is actuated to inflate the cushion.

2. The apparatus of claim 1 wherein said pump is a hollow bulbous member, a portion of which extends outwardly from said pad whereby said extended portion can be deformed to force air through the valve into said cushion.

3. The apparatus of claim 2 wherein said valve includes an enlarged chamber that opens into said connecting line and containing said ball.

4. The apparatus of claim 3 wherein the valve extends outwardly from said pad to permit displacement of the ball from closing contact with the connecting line when the housing is deformed to deflate the cushion.

5. The apparatus of claim 4 wherein said pad contains a base section and a cover section having a pair of openings through which the pump and the valve protrude.

6. The apparatus of claim 5 wherein said adjustable strap is looped over a shaft secured in said base section.

* * * * *